US011780478B1

(12) United States Patent
Rodrigues

(10) Patent No.: US 11,780,478 B1
(45) Date of Patent: Oct. 10, 2023

(54) RAILROAD SWITCH DEVICE

(71) Applicant: Advanced Rail Systems, LL, Riesel, TX (US)

(72) Inventor: Dilson dos Santos Rodrigues, Hewitt, TX (US)

( * ) Notice: Subject to any disclaimer, the term of this patent is extended or adjusted under 35 U.S.C. 154(b) by 0 days.

(21) Appl. No.: 17/731,238

(22) Filed: Apr. 27, 2022

(51) Int. Cl.

| | |
|---|---|
| ***B61L 5/04*** | (2006.01) |
| ***E01B 7/00*** | (2006.01) |
| ***B61L 5/02*** | (2006.01) |
| *B61L 5/10* | (2006.01) |

(52) U.S. Cl.
CPC ..... *B61L 5/045* (2013.01); *B61L 5/02* (2013.01); *E01B 7/00* (2013.01); *B61L 5/10* (2013.01)

(58) Field of Classification Search
CPC .... B61L 5/00; B61L 5/02; B61L 5/045; B61L 5/065; B61L 5/10
See application file for complete search history.

(56) References Cited

U.S. PATENT DOCUMENTS

| | | | | |
|---|---|---|---|---|
| 7,913,956 | B2 * | 3/2011 | Mugg | B61L 5/02 246/435 R |
| 10,794,008 | B2 * | 10/2020 | Rodrigues | E01B 7/00 |
| 2001/0054670 | A1 * | 12/2001 | Franke | B61L 5/107 246/220 |
| 2003/0042370 | A1 * | 3/2003 | Click | E01B 7/22 246/435 R |
| 2018/0073198 | A1 * | 3/2018 | Rodrigues | F15B 20/002 |
| 2021/0025115 | A1 * | 1/2021 | Rodrigues | B61L 5/10 |
| 2021/0129876 | A1 * | 5/2021 | Rodrigues | B61L 5/167 |

FOREIGN PATENT DOCUMENTS

| | | | | |
|---|---|---|---|---|
| WO | WO-2016124425 | A1 * | 8/2016 | B61L 5/10 |

* cited by examiner

*Primary Examiner* — Zachary L Kuhfuss
(74) *Attorney, Agent, or Firm* — Thrasher Associates

(57) ABSTRACT

Disclosed are a railroad switch device for moving railroad switch points. The railroad switch device comprises a switch housing having a first switch operation unit coupled to a first spring unit and a second switch operation unit coupled to a second spring unit to move the first switch operation unit and the second switch operation unit independently; two sensing units, each connected with each of the first switch operation unit and the second switch operation unit to detect a connection status of the first switch operation unit and the second switch operation unit; and a hydraulic manifold to control the movement of the first switch operation unit and the second switch operation unit.

18 Claims, 7 Drawing Sheets

RAILROAD SWITCH DEVICE

TECHNICAL FIELD

The present invention generally relates to a railroad infrastructure, and more particularly relates to railroad switch devices.

PROBLEM STATEMENT AND HISTORY INTERPRETATION CONSIDERATIONS

This section describes technical field in detail and discusses problems encountered in the technical field. Therefore, statements in the section are not to be construed as prior art.

DISCUSSION OF HISTORY OF THE PROBLEM

Railway track switches are mechanical devices that can change a train's course from one track to another. A typical rail track junction comprises two or more tracks that merge together or form a crossover to lead a train from one track to another. A track junction usually has a straight track and a diverging track. Because tracks diverge toward a left-hand side or a right-hand side of the straight track, the tracks are named either a left diverging track or a right diverging track.

The rail tracks that form a junction have three types of rails that form the whole junction. The first is a stock rail, which is a permanent rail that does not undergo any movement and extends from the junction to the length of the track. The second type of rail is an intermediary rail, known as closure rail, which is stationary in nature and does not undergo any movement when the train's course is switched. The third is a switch rail (discussed below).

The closure rails form the overlap between two different train tracks. In a track junction comprising a straight track and a right diverging track, the closure rail of the straight track passes into the path of the right diverging track and the closure rail of the right diverging track passes into the path of the straight track. Thus, the two tracks merge to form a common track. The actual track switching is achieved with the third track, the switch rail, which is movable. The switch rail terminates to form a tapering end and the ends can merge with one of the straight and the diverging tracks when they are moved laterally.

The switch rails are moved using a track switching machine. The machine is usually mechanically, hydraulically or pneumatically operated.

The machine has a switch rod that leads to the movable switch rails. When the tracks have to be aligned between the straight track and the diverging track, the switch rod is reciprocated in a lateral direction to attain a lateral shift of the switch rails. The lateral shift of the switch rails creates a shift between the two tracks.

Originally, track switch machines were operated by an operator manually every time when trains had to change their course between two different tracks. Over time track switching machines evolved to incorporate electric power systems that are remotely controlled by the operator, where the tracks are switched without the presence of the operator at the site.

Numerous switches use one or two springs to allow the train to run through a rail track junction without damaging it or the switch components. However, the realities of the threats to today's logistic infrastructure demand that infrastructure providers consider more than just the operation of the rail switch junction.

Today, we must also be concerned with terrorism and vandalism. If a terrorist wants to create havoc with the Nation's rail network, all they need to do is go to a rail track junction's mainline control point, cut the throw rod and the lock rod, and leave the point detector rod alone. This removes all holding force for the switch machine but the point will stay "in correspondence".

"In correspondence" means in this context that the current systems and devices that detect a switch's positions are detecting that each respective rod is in the correct position (because the components of the point detector rod in the switch machine are in the "correct" position), while the reality outside the switch machine is that the throw rod and lock rod could be literally anywhere in the rail track junction.

This provides the operator with an indication that it is safe to proceed. However, when the next mainline facing point move takes place over the switch, the signal will be green (indicating a safe/correct position). However, without a spring holding force to keep it secured, the switch rail will not stay next to the proper stationary rail and the derailment that occurs will likely be at a high speed.

In view of the foregoing, there is need for a railroad switch device that reliably detects a switch point position.

SUMMARY

The above objective is solved by a railroad switch device comprising features of the claims. The railroad switch device is deployable in vital railroad systems, and said deployability is achieved with two independent rods to hold the points closed, two independent positioning sensing units, the capacity to detect any problem with the point position rods, and is trailable (if a rail car passes over the switch machine and move the points, the machine is not damaged).

Particularly, the railroad switch device comprises a switch housing in which a first switch operation unit coupled to a first spring unit and a second switch operation unit coupled to a second spring unit to move the first switch operation unit and the second switch operation unit independently, wherein the first switch operation unit comprises a first front rod and a first rear rod connected inside a first cylinder and the second switch operation unit comprises a second front rod and a second rear rod connected inside a second cylinder and wherein, the first spring unit formed by a first spring and a first spring pivot bar and the second spring unit formed by a second spring and a second spring pivot bar to provide holding force for the railroad switch points. Further, the switch housing comprises two sensing units, where each sensing unit is connected with each of the first switch operation unit and the second switch operation unit to detect a connection status of the first switch operation unit and the second switch operation unit, wherein the connection status indicates if a connection of the first switch operation unit and the second switch operation unit with a rail is disconnected, cut, or broke and a hydraulic power unit and a hydraulic manifold to control the movement of the first switch operation unit and the second switch operation unit.

Of course, the present is simply a Summary, and not a complete description of the invention.

BRIEF DESCRIPTION OF THE DRAWINGS

Various aspects of the invention and its embodiment are better understood by referring to the following detailed description. To understand the invention, the detailed description should be read in conjunction with the drawings.

DESCRIPTION OF AN EXEMPLARY PREFERRED EMBODIMENT INTERPRETATION CONSIDERATIONS

While reading this section (Description of An Exemplary Preferred Embodiment, which describes the exemplary embodiment of the best mode of the invention, hereinafter referred to as "exemplary embodiment"), one should consider the exemplary embodiment as the best mode for practicing the invention during filing of the patent in accordance with the inventor's belief. As a person with ordinary skills in the art may recognize substantially equivalent structures or substantially equivalent acts to achieve the same results in the same manner, or in a dissimilar manner, the exemplary embodiment should not be interpreted as limiting the invention to one embodiment.

The discussion of a species (or a specific item) invokes the genus (the class of items) to which the species belongs as well as related species in this genus. Similarly, the recitation of a genus invokes the species known in the art. Furthermore, as technology develops, numerous additional alternatives to achieve an aspect of the invention may arise. Such advances are incorporated within their respective genus and should be recognized as being functionally equivalent or structurally equivalent to the aspect shown or described.

A function or an act should be interpreted as incorporating all modes of performing the function or act, unless otherwise explicitly stated. For instance, sheet drying may be performed through dry or wet heat application, or by using microwaves. Therefore, the use of the word "paper drying" invokes "dry heating" or "wet heating" and all other modes of this word and similar words such as "pressure heating".

Unless explicitly stated otherwise, conjunctive words (such as "or", "and", "including", or "comprising") should be interpreted in the inclusive and not the exclusive sense.

As will be understood by those of the ordinary skill in the art, various structures and devices are depicted in the block diagram to not obscure the invention. In the following discussion, acts with similar names are performed in similar manners, unless otherwise stated.

The foregoing discussions and definitions are provided for clarification purposes and are not limiting. Words and phrases are to be accorded their ordinary, plain meaning, unless indicated otherwise.

DESCRIPTION OF THE DRAWINGS, A PREFERRED EMBODIMENT

The present invention resolves several issues with, and improves upon a variety of aspects of, existing railroad switch devices/machines in use today. The present invention focuses on a direct holding force to a switch point (or railroad switch point), and on being able to monitor if the holding force is lost, thus ensuring security of the railroad switch devices. In addition, the present invention does so with fewer parts and (optionally) with a smaller footprint and with a higher reliability. The present invention has particular advantages and features (as explained below and in the claims) in that it is deployable into railroads that require vital systems.

Figure 1:
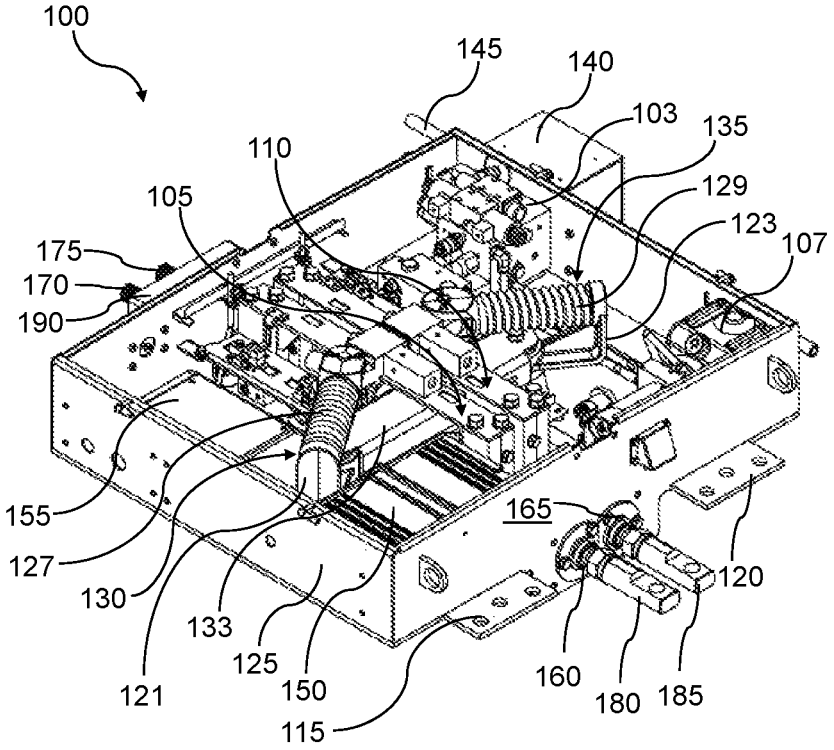
FIG. 1 is a perspective view of a railroad switch device.
Figure 2:
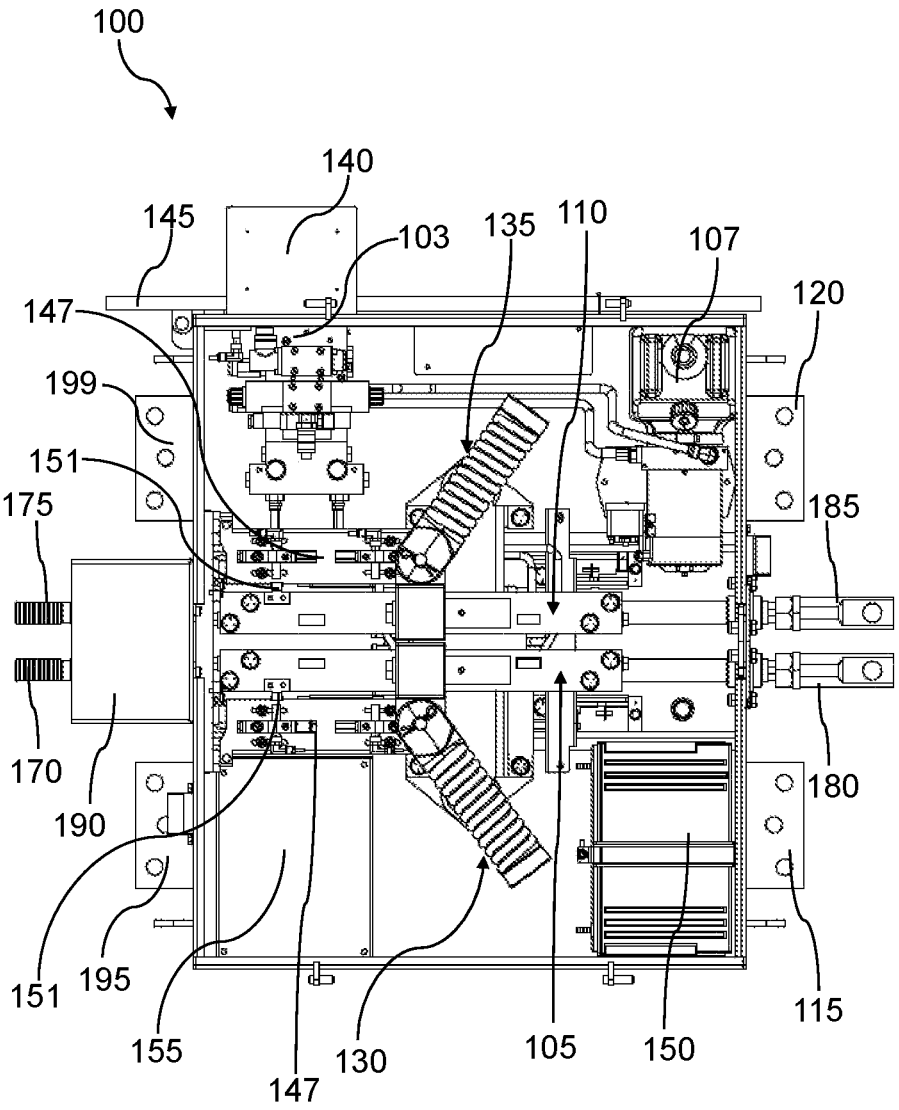
FIG. 2 is a top-down view of the railroad switch device.
Figure 3:
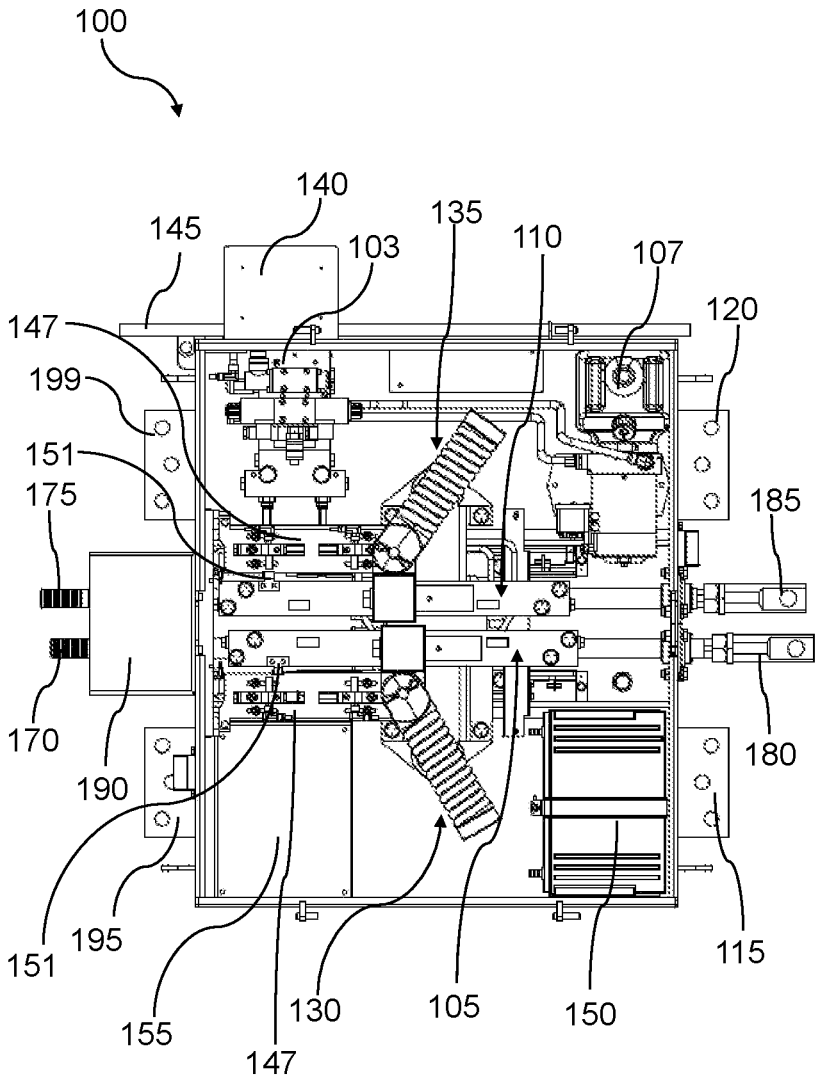
FIG. 3 is a top-down view of the railroad switch device with a cylinder out of position.
Figure 4:
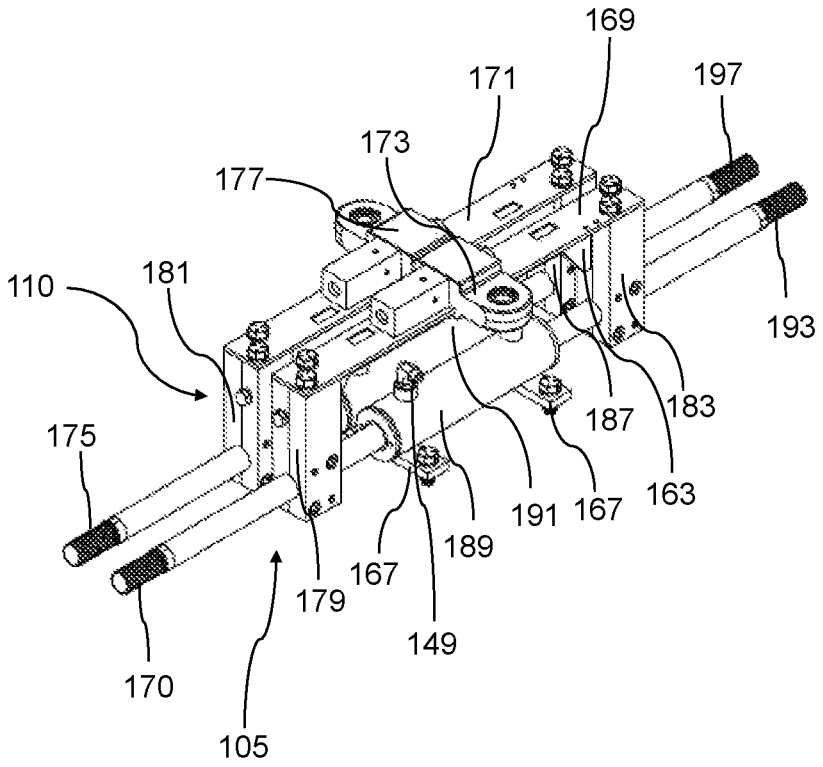
FIG. 4 is a perspective view of a pair of cylinders.
Figure 5:
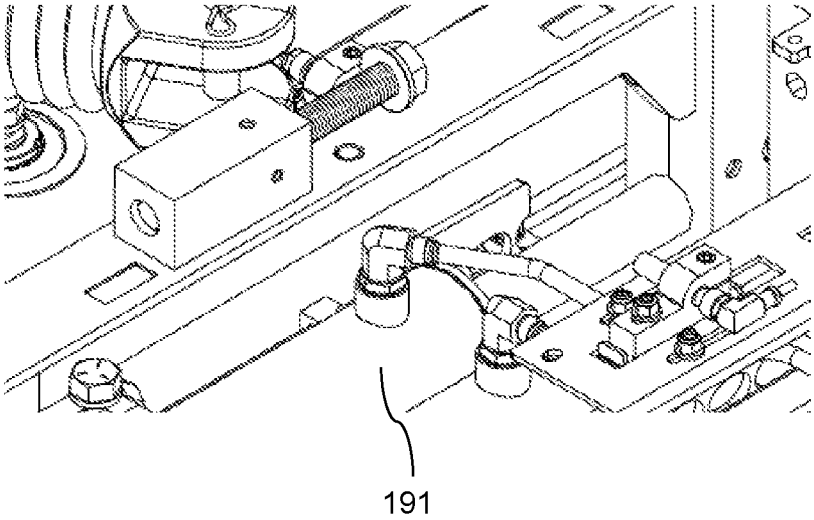
FIG. 5 is a close-up perspective view showing a cylinder.
Figure 6:
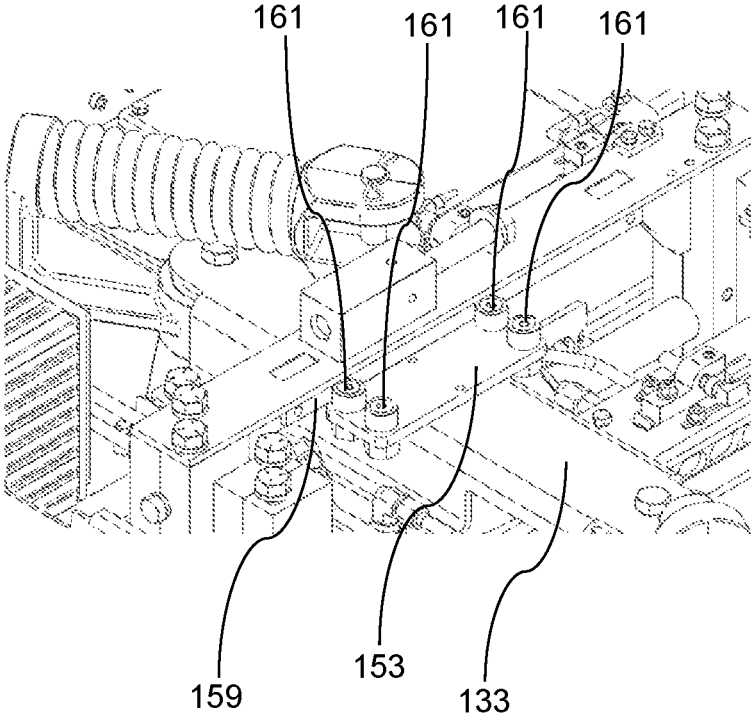
FIG. 6 is a close-up perspective view depicting bearings.
Figure 7:
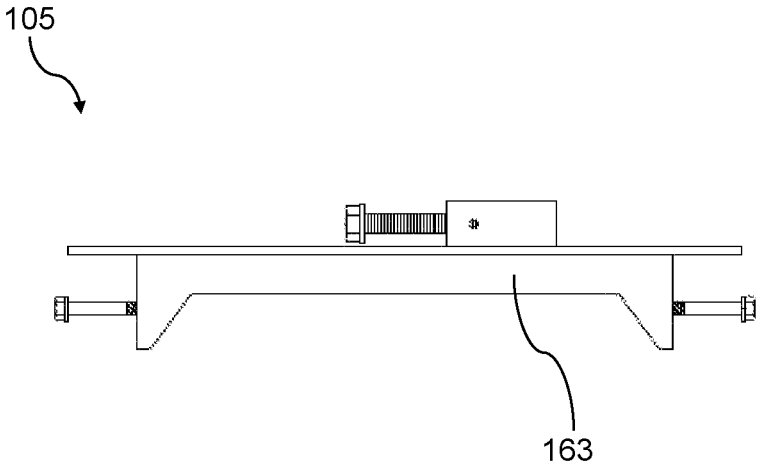
FIG. 7 is an isolated close-up view of a guide-bar.

In opening, simultaneous reference is made to FIG. 1 through FIG. 7, in which FIG. 1 is a perspective view of a railroad switch device (aka "switch machine") 100, FIG. 2 is a top-down view of the railroad switch device 100, FIG. 3 is a top-down view of the railroad switch device 100 with a cylinder out of position, FIG. 4 is a perspective view of a pair of cylinders, FIG. 5 is a close-up perspective view showing a cylinder, FIG. 6 is a close-up perspective view depicting bearings and FIG. 7 is an isolated close-up view of a guide-bar.

The switch machine 100 and its components are made of steel, aluminum, metal alloys or any suitable material known to those of ordinary skill in the arts. The switch machine 100 is preferably fully operational to temperatures of −40C and +80C and is preferably 8.5 inches high. The switch machine 100 may be controlled through at least one of: a local PLC, and a remote PLC. The PLC is used to control and monitor input signals from various input sensors, which reports events and conditions occurring in a controlled process such as power on/off or emergency cut-off of the switch machine 100. The voltages handled by the switch machine 100 tends to be relatively high. The voltages handled by the switch machine 100 may be direct current (DC) or alternating current (AC). However, the electronic components of the PLC typically operate at much lower DC voltages, e.g., 9-30 volts.

The local and remote programmable logic controller (PLC) used in the present invention are digital computer used for the automation of electromechanical processes, such as control of machinery on factory assembly lines, or light fixtures. The aforementioned PLCs are designed for multiple inputs and output arrangements, extended temperature ranges, immunity to electrical noise, and resistance to vibration and impact. Programs to control machine operation are typically stored in battery backup or non-volatile memory.

The switch machine 100 is trailable and configured to move railroad switch points. The switch machine 100 comprises a switch housing 125. The switch housing 125 is top-enclosed via a switch lid (not shown) and provides mounting structure or lateral support for and environmental protection to the switch machine's 100 components such as a pair of housing feet 115, 120, a hand pump cover 140, a hand pump handle 145, a set of flanges and bushings 160, 165, a rod cover 190 and a pair of front feet 195, 199, for example. The switch housing 125 is configured to secure a hydraulic manifold 103, a pair of switch operation units 105, 110, a hydraulic power unit 107, a pair of spring units 130, 135, a center bracket 133, a battery 150, an electronic tray and shelf 155, a plurality of bearings 161 supported by a bearing tray 153, at least one cylinder mount 167, a pair of alignment bars 159 and a pair of guide bars 163.

The hydraulic manifold 103 regulates fluid flow between pumps and actuators and other components of a hydraulic system of the switch machine 100. The hydraulic manifold 103 includes a hand throw pump to move the pair of switch operation units 105, 110 during installation and also move without power.

The pair of switch operation units 105, 110 (as shown in FIG. 4) assists in moving the railroad switch points or switching railway tracks, and is used to increase the operation safety. The pair of switch operation units 105, 110 moves the railroad switch points at the same time, and each switch operation unit has an independent point position indication. Additionally, each switch operation unit is connected to one of the railroad switch points, and has an independent spring unit 130, 135 to provide holding force for the railroad switch points. The pair of switch operation units 105, 110 comprises a pair of front rods 170, 175 partially enclosed by the rod cover 190 and a pair of rod adapters 180, 185 that acts as a connection point to the railway tracks and encloses a pair of rear rods 193, 197. The pair of switch operation units 105, 110 further comprises a pair of cylinders 189, 191, a pair of front rod bars 179, 181, a pair of rear rod bars 183, 187, a pair of spring pivot brackets 173, 177 and a pair of top cylinder bars 169, 171 (shown in FIG. 4).

Referring to FIG. 4, the pair of front rods 170, 175 and the pair of rear rods 193, 197 are connected/present inside the pair of cylinders 189, 191. That is, a first front rod 170 and a first rear rod 193 are connected inside a first cylinder 189 and a second front rod 175 and a second rear rod 197 are connected inside a second cylinder 191. Alternatively, a front rod and a rear rod are part of a single rod that passes through the respective cylinders, that is, a first rod passes through the first cylinder 189 and a second rod passes through the second cylinder 191. The first rod and the second rod being held in place by a spring holding force generated via a first spring unit 130 and a second spring unit 135 respectively (discussed below).

Further, the pair of front rods 170, 175 and the pair of rear rods 193, 197 are attached to the pair of front rod bars 179, 181 and the pair of rear rod bars 183, 187 respectively. That is, the first front rod 170 is attached to a first front rod bar 179, the second front rod 175 is attached to a second front rod bar 181, the first rear rod 193 is attached to a first rear rod bar 183 and the second rear rod 197 is attached to a second rear rod bar 187. Each of the pair of front rod bars 179, 181 and the pair of rear rod bars 183, 187 comprised of a hole/groove to accommodate each of the pair of front rods 170, 175 and the pair of rear rods 193, 197 which is further connected to respective cylinders from the pair of cylinders 189, 191. Such an arrangement makes it easy to install the switch machine 100 at either the right or left side of the railway tracks. The pair of cylinders 189, 191 provides constant forward movement and reverse movement to define an operation cycle and in time an operation period. The pair of cylinders 189, 191 comprised of a plurality of hydraulic fittings 149 through which the hydraulic power unit 107 is operationally connected to the pair of cylinders 189, 191 via the hydraulic manifold 103. The pair of cylinders 189, 191 includes hydraulic cylinders and is mounted/installed in the switch housing 125 using the at least one cylinder mount 167.

Each of the pair of front rod bars 179, 181 and the pair of rear rod bars 183, 187 are connected with the pair of top cylinder bars 169, 171 forming "C" shape, wherein the first front rod bar 179 and the first rear rod bar 183 are connected via a first top cylinder bar 169 and the second front rod bar 181 and the second rear rod bar 187 are connected via a second top cylinder bar 171. A sensor target 151 (as shown in FIG. 2 and FIG. 3) is mounted at each of the first top cylinder bar 169 and the second top cylinder bar 171 that activates/flags each of two sensing units 147 (as shown in FIG. 2 and FIG. 3) having one or more proximity or position sensors mounted to a bracket using clamp(s) at a desired reverse position and forward position to detect position of cylinder rods, i.e., the pair of front rods 170, 175 and the pair of rear rods 193, 197 and adjust them, where each sensing unit 147 is installed in parallel to the rods (or cylinder rods). Each sensing unit 147 utilizes two PNP (positive-negative-positive) high quality, focused beam proximity sensors as is readily understood by those of skill in the art upon reading this disclosure. Alternatively, other types of proximity sensors may be used. Further, the sensor targets 151 are specifically sized to provide fine adjustments for detection of the railroad switch points opening to meet mainline requirements. The sensor targets 151 follow a movement of the cylinder rods i.e., the pair of front rods 170, 175 and the pair of rear rods 193, 197.

Unlike conventional devices, the switch machine 100 ensures that if any of the cylinder rods is disconnected from the railroad switch points, a spring force (described below) will push the sensor targets 151 away from the respective sensing units 147. As an example, a throwing stroke of the switch machine 100 is 6.0 inches to provide a full 0.625 inches of over stroke capability on both the normal and reverse point position when the point throw distance is 4.75 inches.

Further, the pair of top cylinder bars 169, 171 accommodates the pair of spring pivot brackets 173, 177. That is, the pair of spring pivot brackets 173, 177 is mounted on the pair of top cylinder bars 169, 171 to form a spring holding force assembly. The spring holding force assembly includes the pair of spring pivot brackets 173, 177 and the pair of spring units 130, 135, where a first spring pivot bracket 173 is mounted on or attached to the first top cylinder bar 169 and a second spring pivot bracket 177 is mounted on or attached to the second top cylinder bar 171. The pair of spring units 130, 135 is formed by a pair of springs 127, 129 and a pair of spring pivot bars 121, 123 as shown in FIG. 1, where the first spring unit 130 is formed by a first spring 127 and a first spring pivot bar 121 and the second spring unit 135 is formed by a second spring 129 and a second spring pivot bar 123.

As shown in FIGS. 1 through 4, the pair of spring units 130, 135 is mounted on or coupled with the pair of switch operation units 105, 110. That is, each switch operation unit 105, 110 is connected to one of the railroad switch points, and has an independent spring unit 130, 135 having the first spring 127 and the second spring 129 to provide holding force for the railroad switch points, where a first switch operation unit 105 is connected with the first spring unit 130 and a second switch operation unit 110 is connected with the second spring unit 135. Each spring unit can move the first switch operation unit 105 and the second switch operation unit 110 independently to detect connection status, i.e., if a connection of each of the pair of switch operation units 105, 110 with the rail is broken, cut or disconnected. Such arrangement adds an extra layer of security to the switch machine 100 and results in enhanced operator safety and less chances of injuries or death.

The first spring 127 and the second spring 129 are configured to produce a continuous thrust force for holding the railroad switch points closed in forward position and reverse position. Further, the first spring 127 is coupled to the first spring pivot bracket 173 from a first end and coupled to the first spring pivot bar 121 from a second end and the second spring 129 is coupled to the second spring pivot bracket 177 from a first end and coupled to the second spring pivot bar 123 from a second end. The first spring pivot bar 121 and the second spring pivot bar 123 are further attached to the center bracket 133.

The center bracket 133 comprises the plurality of bearings 161. As shown in FIG. 6, the plurality of bearings 161 is installed at the center bracket 133, wherein two bearings are used to guide the movement of the first top cylinder bar 169 and two bearings are used to guide the movement of the second top cylinder bar 171 with the help of the pair of guide bars 163. The plurality of bearings 161 is housed in the bearing tray 153, which is placed near/above the center bracket 133. The plurality of bearings 161 prevents rod rotation caused by external forces or aligns external forces. This also allows the use of the sensing units 147 to detect the rod position to achieve high precision.

The plurality of bearings 161 may be a roller bearing, for example. The plurality of bearings 161 keeps the movement straight and aligned and maintains a constant distance between each of the sensing units 147 and the sensor targets 151 for better position detection. The plurality of bearings 161 also keeps a precise point position indication. If a point connection is lost, connecting bar broken, connecting pin broken, etc, the independent spring action will move the pair of cylinders 189, 191 out of the sensing units' detection/calibration range. When the sensing units 147 detect that any of the cylinder is out of position, the switch machine 100 indicates an out of position indication that increases the system operational safety.

To avoid the pair of guide bars 163 to be wear in constant contact with the plurality of bearings 161, the pair of alignment bars 159 is provided, where one alignment bar is installed per guide bar. Each of the pair of alignment bars 159 is a steel bar with hardened surface that is installed between the plurality of bearings 161 and an internal face of each of the pair of guide bars 163 as shown in FIG. 6.

As stated earlier, the switch machine 100 comprises the battery 150, the hydraulic power unit 107, the electronic tray and shelf 155, the set of flanges and bushings 160, 165, the pair of housing feet 115, 120 and the pair of front feet 195, 199.

The battery 150 is a 12V DC battery. Other suitable battery rating may be used. The battery 150 provides longer operation time on battery backup. Alternatively, another power source can be used that can be an AC power source, or combination of the AC power source with the DC type battery. The switch machine 100 operates for 100 throws on the 12 VDC battery without charging. The 12 VDC operation of the switch machine 100 eliminates the need for a separate set of expensive batteries in the signal bungalow for 24 VDC back up required for the traditional switch machines. When in standard operation, one rod provides +12 VDC position indications and the other rod provides −12 VDC position indications. The indications are monitored by a control system logic (either by a switch control processor or a vital controller for the signal system or both) to ensure that no proximity sensor has failed. If an input from the proximity sensor is shorted, the logic of the control system will detect this and cause the system to show that an out of correspondence condition has occurred.

Further, the switch machine 100 includes a hand throw assembly, which acts as a backup in case of power failure. The hand throw assembly manually pumps hydraulic oil (stored in a hydraulic oil reservoir) for moving the pair of cylinders 189, 191 in the forward position and the reverse position. When the hand pump cover 140 is opened using the hand pump handle 145, the switch machine operation is disabled and an indication that it is opened is provided to an electric system. It can be installed at the left or right side of the railway track with minimal changes to make to the railroad replace others switch device.

The hydraulic power unit 107 supplies the hydraulic power to a hydraulic unit having the hydraulic manifold 103 to move the pair of cylinders 189, 191. After the pair of cylinders 189, 191 moves the railroad switch points through the rods from one position to another, the hydraulic power is turned off and the railroad switch points are kept closed by the spring force. If a train runs through the switch machine 100, the pair of cylinders 189, 191 can completely move to the other position without damaging the switch machine's components; this means that there is no hydraulic restriction to the movement of the railroad switch points.

The electronic tray and shelf 155 is configured to accommodate/secure additional components related to the switch machine 100.

The set of flanges and bushings 160, 165 are used for mounting and supporting the rods (i.e., the first front rod and the first rear rod connected inside the first cylinder and the second front rod and the second rear rod connected inside the second cylinder) and preventing to-and-fro (backward and forward) movement of the rods caused by the train running through a track coupled to the switch machine 100.

The pair of housing feet 115, 120 and the pair of front feet 195, 199 are configured to provide further structural support to the switch housing 125 and a target assembly, for example. The pair of housing feet 115, 120 and the pair of front feet 195, 199 help in installing/mounting the switch machine 100 at a suitable location.

Further, it may be noted that one component of the switch machine 100 may be mechanically connected to another component of the switch machine 100 using one or more connecting/fastening means such as bolts, screws, pins, for example or may be snap-fitted.

An additional advantage of the present invention is that the switch machine 100 provides a faster throw time of about 2.6 seconds. This throw speed is faster than that of traditional switch machines (handles longer turnouts).

It may be noted that although the present invention shows various elements of the switch machine 100, but it is to be understood that other alternatives are not limited thereon. Further, the labels or names of the elements/components are used only for illustrative purpose and do not limit the scope of the present invention. The shape and size of the various elements in the switch machine 100 do not limit the scope of the present invention.

Unless otherwise defined, all technical and scientific terms used herein have the same meaning as commonly understood by one of ordinary skill in the art to which this invention belongs. Although methods and materials similar to or equivalent to those described herein can be used in the practice or testing of equivalent systems and methods, suitable systems and methods and are described above.

Although the invention has been described and illustrated with specific illustrative embodiments, it is not intended that the invention be limited to those illustrative embodiments. Those skilled in the art will recognize that variations and modifications can be made without departing from the spirit of the invention. Therefore, it is intended to include within the invention, all such variations and departures that fall within the scope of the appended claims and equivalents thereof.

TABLE

LIST OF REFERENCE NUMERALS

| Reference Numeral | Element Name |
|---|---|
| 100 | Switch machine or railroad switch device |
| 103 | Hydraulic manifold |
| 105, 110 | Pair of switch operation units |
| 107 | Hydraulic power unit |
| 115, 120 | Pair of housing feet |

TABLE-continued

LIST OF REFERENCE NUMERALS

| Reference Numeral | Element Name |
|---|---|
| 125 | Switch housing |
| 121, 123 | Pair of spring pivot bars |
| 127, 129 | Pair of springs |
| 130, 135 | Pair of spring units |
| 133 | Center bracket |
| 140 | Hand pump cover |
| 145 | Hand pump handle |
| 147 | Sensing units |
| 149 | Plurality of hydraulic fittings |
| 150 | Battery |
| 151 | Sensor targets |
| 153 | Bearing tray |
| 155 | Electronic tray and shelf |
| 159 | Pair of alignment bars |
| 160, 165 | Set of flanges and bushings |
| 161 | Plurality of bearings |
| 163 | Pair of guide bars |
| 167 | At least one cylinder mount |
| 169, 171 | Pair of top cylinder bars |
| 170, 175 | Pair of front rods |
| 173, 177 | Pair of spring pivot brackets |
| 179, 181 | Pair of front rod bars |
| 183, 187 | Pair of rear rod bars |
| 180, 185 | Pair of rod adapters |
| 189, 191 | Pair of cylinders |
| 190 | Rod cover |
| 193, 197 | Pair of rear rods |
| 195, 199 | Pair of front feet |

What is claimed is:

1. A railroad switch device for moving railroad switch points, the railroad switch device comprising:

a switch machine housing comprising:

a first switch operation unit coupled to a first spring unit and a second switch operation unit coupled to a second spring unit to move the first switch operation unit and the second switch operation unit respectively, the first switch operation unit and the second switch operation unit are placed side by side to reciprocate independently, the first switch operation unit comprises a first front rod and a first rear rod connected inside a first cylinder and the second switch operation unit comprises a second front rod and a second rear rod connected inside a second cylinder, the first spring unit formed by a first spring and a first spring pivot bar and the second spring unit formed by a second spring and a second spring pivot bar to provide holding force for the railroad switch points;

the first spring coupled to a first spring pivot bracket from a first end and coupled to the first spring pivot bar from a second end and the second spring coupled to a second spring pivot bracket from a first end and coupled to the second spring pivot bar from a second end, wherein a clevis end of the first spring pivot bracket is coupled to a first top cylinder bar of the first switch operation unit and a clevis end of the second spring pivot bracket is coupled to a second top cylinder bar of the second switch operation unit such that the clevis end of the first spring pivot bracket and the clevis end of the second spring pivot bracket are placed side by side;

two sensing units, a first sensing unit connected with the first switch operation unit and a second sensing unit connected with the second switch operation unit to detect a connection status of the first switch operation unit and the second switch operation unit; and a hydraulic manifold to control the movement of the first switch operation unit and the second switch operation unit.

2. The railroad switch device according to claim 1 wherein, the switch machine housing provides lateral support for a pair of housing feet, a hand pump cover, a hand pump handle, a set of flanges and bushings, a rod cover and a pair of front feet.

3. The railroad switch device according to claim 1 wherein, the first front rod is attached to a first front rod bar, the second front rod is attached to a second front rod bar, the first rear rod is attached to a first rear rod bar and the second rear rod is attached to a second rear rod bar.

4. The railroad switch device according to claim 3 wherein, the first front rod bar and the first rear rod bar are connected via the first top cylinder bar and the second front rod bar and the second rear rod bar are connected via the second top cylinder bar;

the first spring pivot bracket is attached to the first top cylinder bar and the second spring pivot bracket is attached to the second top cylinder bar; and a sensor target mounted at each of the first top cylinder bar and the second top cylinder bar that flags each sensing unit having one or more proximity sensors mounted to a bracket at a desired reverse position and forward position to detect position of and adjust the first front rod and the first rear rod connected inside the first cylinder and the second front rod and the second rear rod connected inside the second cylinder, wherein each sensing unit is installed in parallel to the first front rod and the first rear rod connected inside the first cylinder and the second front rod and the second rear rod connected inside the second cylinder respectively.

5. The railroad switch device according to claim 1 wherein, the first front rod and the second front rod are partially enclosed by a rod cover and the first rear rod and the second rear rod are enclosed by each of a pair of rod adapters.

6. The railroad switch device according to claim 1 wherein, a pair of cylinders having the first cylinder and the second cylinder provides constant forward movement and reverse movement to define an operation cycle and in time an operation period.

7. The railroad switch device according to claim 1 wherein, a pair of cylinders having the first cylinder and the second cylinder comprises a plurality of hydraulic fittings for operationally connecting with a hydraulic power unit via the hydraulic manifold and the pair of cylinders being mounted in the switch machine housing using at least one cylinder mount.

8. The railroad switch device according to claim 1 wherein, the connection status indicates if a connection of the first switch operation unit and the second switch operation unit with a rail is disconnected, cut, or broke.

9. The railroad switch device according to claim 1 wherein, the first spring and the second spring are configured to produce a continuous thrust force for holding the railroad switch points closed in forward position and reverse position.

10. The railroad switch device according to claim 1 wherein, the first spring pivot bar and the second spring pivot bar are attached to a center bracket.

11. The railroad switch device according to claim 1 further comprising a plurality of bearings housed in a bearing tray installed near a center bracket, wherein two bearings are used to guide the movement of the first top cylinder bar and two bearings are used to guide the movement of the second top cylinder bar with the help of a pair of guide bars.

12. The railroad switch device according to claim 1 further comprising a plurality of bearings housed in a bearing tray installed near a center bracket, wherein the plurality of bearings aligns external forces and maintains a constant distance between a sensing unit and a sensor target for better position detection.

13. The railroad switch device according to claim 1 further comprising a pair of alignment bars, where an alignment bar is a steel bar with hardened surface that is installed between a plurality of bearings and an internal face of each guide bar.

14. The railroad switch device according to claim 1 further comprising a battery having a 12V DC rating for operation of the railroad switch device.

15. The railroad switch device according to claim 1 further comprising a hand throw assembly configured to manually pump hydraulic oil stored in a hydraulic oil reservoir for moving the first cylinder and the second cylinder in a forward position and a reverse position.

16. The railroad switch device according to claim 1 further comprising an electronic tray and shelf configured to accommodate additional components related to the railroad switch device.

17. The railroad switch device according to claim 1 further comprising a set of flanges and bushings to prevent to and fro movement of the first front rod and the first rear rod connected inside the first cylinder and the second front rod and the second rear rod connected inside the second cylinder.

18. The railroad switch device according to claim 1 further comprising a pair of housing feet and a pair of front feet configured to provide structural support to the switch machine housing.

* * * * *